US005120905A

United States Patent [19]

Cousin et al.

[11] Patent Number: 5,120,905

[45] Date of Patent: Jun. 9, 1992

[54] ELECTROCARRIER CABLE

[75] Inventors: Jean-Claude Cousin, Wervicq-Sud, France; Yves Delvael, Wervik, Belgium

[73] Assignee: Cousin Freres (S.A.), France

[21] Appl. No.: 490,606

[22] PCT Filed: Jul. 17, 1989

[86] PCT No.: PCT/FR89/00376

§ 371 Date: Mar. 13, 1990

§ 102(e) Date: Mar. 13, 1990

[87] PCT Pub. No.: WO90/01209

PCT Pub. Date: Feb. 8, 1990

[30] Foreign Application Priority Data

Jul. 18, 1988 [FR] France ..... 88 09697

[51] Int. Cl.[5] ..... H01B 7/00

[52] U.S. Cl. ..... 174/113 C; 174/131 A

[58] Field of Search ..... 174/113 C, 131 A, 131 B, 174/131 R

[56] References Cited

U.S. PATENT DOCUMENTS

| | | | |
|---|---|---|---|
| 2,212,700 | 8/1940 | Peterson et al. | 174/108 |
| 3,980,808 | 9/1976 | Kikuchi et al. | 174/131 A |
| 4,010,619 | 3/1977 | Hightower et al. | 174/115 |
| 4,034,138 | 7/1977 | Babayan | 57/251 |
| 4,084,065 | 4/1978 | Swenson | 174/131 A |
| 4,449,012 | 5/1984 | Voser | 174/131 A |
| 4,743,712 | 5/1988 | Lee | 174/113 C |
| 4,820,012 | 4/1989 | Asai | 174/113 C |
| 4,835,340 | 5/1989 | Muz | 174/131 A |
| 4,861,947 | 8/1989 | Altermatt et al. | 174/113 C |

FOREIGN PATENT DOCUMENTS

| | | | |
|---|---|---|---|
| 54784 | 12/1981 | European Pat. Off. . | |
| 3241425 | 5/1984 | Fed. Rep. of Germany . | |
| 3306316 | 8/1984 | Fed. Rep. of Germany . | |
| 2023328 | 12/1979 | United Kingdom | 174/113 C |

*Primary Examiner*—Morris H. Nimmo

*Attorney, Agent, or Firm*—Eckert, Seamans, Cherin & Mellott

[57] ABSTRACT

An electrocarrier cable has conductor elements and support or carrier elements. The conductors are lapped on insulating cores and are enclosed in fluorinated sheaths to form conductor elements which are stranded to an elongated central core, preferably with interleaved support elements. A braid of relatively inextensible fibers, i.e., aramide fibers, encloses the conductor elements and is coated with a polyurethane sheath. The cable is arranged such that the aramide fibers fail in tension before the conductors fail, and is particularly useful in a self-supporting cable for carrying low level currents, such as in the field of oceanography.

6 Claims, 1 Drawing Sheet

ELECTROCARRIER CABLE

The present invention concerns an electrocarrier cable, that is to say a cable for conducting electricity, in particular low currents such as those carrying telecommunication signals, or more generally data signals, and for supplying power to measuring instruments or information processing systems.

Currently the electrical conductor or conductors, generally arranged in parallel, have to be strengthened by strength members, generally of steel. These strength members provide the mechanical strength and account for a considerable percentage of the weight and the volume of the electrocarrier. An electrocarrier cable of this kind is heavy and may break under its own weight. The strength/weight relationship is referred to as the self-weight breaking length of the cable.

Thus, for example, an electrocarrier cable comprising $7\times0.56$ mm$^2$ conductors requires an armouring comprising a first layer of 20 galvanised steel wires with a diameter of 1.4 mm and a second layer stranded with the opposite lay and made up of 35 wires with a diameter of 1.1 mm (steel = 1,800 N/mm$^2$). This cable weighs 680 g/m in air and has a breaking strength of 9,500 DaN; suspended in air, this cable will break under its own weight for a length of: 9,500/680 = 13.97 km.

In this type of cable the copper conductors inevitably break after stretching by a very small amount, before the overall breaking strength of the cable is reached. These conductors generally break at loads below 50% of the strength of the strength member and the electrocarrier cable then no longer fulfills its electrical function.

Also, it has been observed in the field of hydrolysis, for example, that scientific measurements with an accuracy in the order of 1 ppm were falsified by the presence of micro-particles of zinc or of grease from the galvanised steel carrier member. The problem with conductor cables is that the cable may break under its own weight when suspended in a fluid such as air or water even with no other load applied. When breaking loads are applied to the cable the electrical circuit tends to be broken before the strength members break, with the result that the entire cable must be replaced.

There is known from U.S. Pat. No. 4,034,138 a low-density high-strength electromechanical cable including multifilament fibres of aromatic polyamides covered with a polyurethane protective coating to prevent mutual damage to the aramide fibres by abrasion. However, the conductor wires are parallel to the carrier fibres and have a higher resistance to stretch than the strength members.

EP-A-0,054,784 concerns a telephone cable in which the carrier members are aramide fibres in the form of a central core and strands twisted up with the conductors. DE-A-3,241,425 concerns a conductor cable in which the central conductor members are surrounded by a braided aramide strength member which constitutes the carrier member.

An object of the present invention is an electrocarrier cable that is light in weight and whose conductive part can break only if the carrier members of the cable have already mechanically broken. In accordance with the invention, and differing in this respect from what is observed with conventional cables, the strength members of the cable break before the conductor or conductors. Should the cable break, the conductor or conductors are loaded at the last possible moment, after the carrier member has itself given way.

In accordance with the invention the electrocarrier cable comprising carrier members resistant to traction and electrical conductor members enclosed within an extruded sheath is characterised in that the conductor members are integrated into an elastic central core structure surrounded by an aramide fibre strength member, the conductor members including at least one metal wire wound onto a strand.

The elastic core structure comprises a twisted fibre composite central core. Around this core are disposed two or more conductors in as tight as possible a helical arrangement to constitute a homogeneous strand. There might be, for example, a (1+6) elastic core structure in which the "1" is the central core and the "6" comprise, for example, two diametrally opposed electrical conductors and four intermediate polyurethane aramide composite members of the same diameter, for example.

There might instead be a (1+12) elastic core structure in which the "1" is the central core and the "12" comprise, for example, six conductors and six intermediate members of the same diameter, or 12 conductors.

The basic electrical wires, advantageously of copper or copper alloy, are wound onto a core, generally of high modulus aramide with a short lay and contiguous turns. However, given that in normal operation the strands are not loaded in traction, they may be made from a material without particular physical properties. To facilitate sliding of the electrical conductors within the elastic core structure, in particular on passing over pulley wheels, the sheathing of the electrical conductors will preferably be an insulative resin with a low coefficient of adhesion such as a fluorinated product.

The stranding direction of the electrical conductors and/or intermediate members is advantageously opposite to the stranding direction of the core structure, to obtain an anti-twisting effect.

When a core structure of this kind is loaded in traction it stretches without loading or distorting the basic wires. This is due to the combination of the spiral arrangement of the basic wires within the conductor and the stranding of the conductors within the core structure. This technique results in long lays. However, this loading occurs only in exceptional cases as it presupposes that the strength members have stretched or broken.

The high-modulus fibre strength or carrier member may be constructed in various ways such as braiding or twisting. In the case of braiding, the braid is preferably made up from aromatic polyamide fibres, for example, which have the advantage of very high resistance to stretch and of being as strong as steel wires 15 times heavier than them in water. These fibres can receive a protective coating. The braid must have a long lay with a braiding angle of 15° or less to minimise its elasticity.

Also, such fibres have the advantage, especially in oceanographic applications, of being electrically insulative which avoids problems of spurious conduction, the chemical inertia of the material eliminating corrosion problems.

In some cases a thin film will be applied between the elastic core structure and the carrier member, a polyurethane film, for example, to make the assembly cohere and to prevent slipping of the core structure relative to the carrier member when the cable is loaded.

The protective sheath is generally extruded in a preferably elastomer material such as polyurethane, for example. The sheath does not play any role in the resistance to traction and its purpose is to protect the Carrier member and the elastic core structure against abrasion, and more generally against attack by the environment.

Other characteristics and advantages of the present invention will emerge from the following description of one specific embodiment given by way of non-limiting example with reference to the figures in which.

Figure 1:
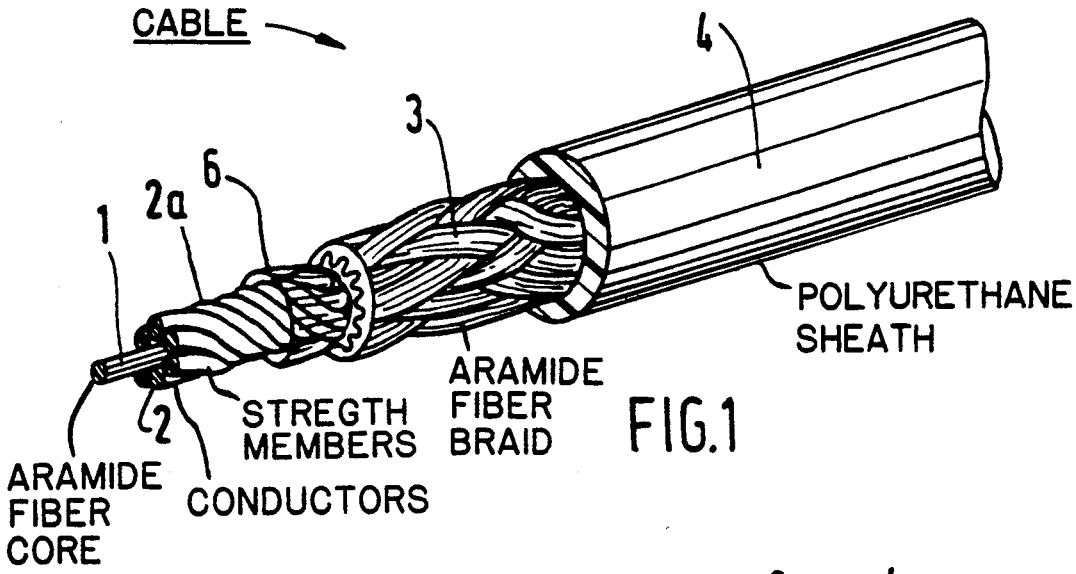
FIG. 1 is a perspective view of a cable in accordance with the invention.
Figure 2:
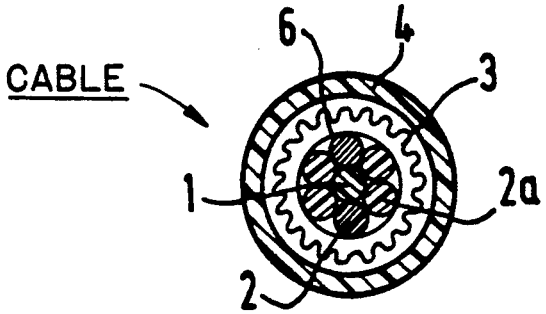
FIG. 2 is a view of the same cable in transverse cross-section.

FIG. 1 shows a central core 1 which, as previously indicated, is made up of twisted aramide fibres secured together by polyurethane. Around the core 1 are conductors 2 and/or intermediate members 2*a*, of which there are six in the example shown. These are twisted with a close lay, for example a pitch of 32 mm for an elastic core structure with a diameter of 4.7 mm. Like the core 1, the intermediate members are advantageously aramide fibres integrated into a polyurethane matrix. The electrical conductors, constituted by a core 2*b* onto which is wound one or preferably several metal wires 7 are coated with a thin layer 5 of polytetrafluoroethylene (FIG. 3) or other fluorinated product to enable relative sliding between the conductors 2 (as well as conductive wires 7) and the intermediate members 2*a* when the cable is loaded.

The electrical conductors and/or intermediate members are preferably stranded in the opposite direction to obtain an anti-twisting effect.

Figure 3:
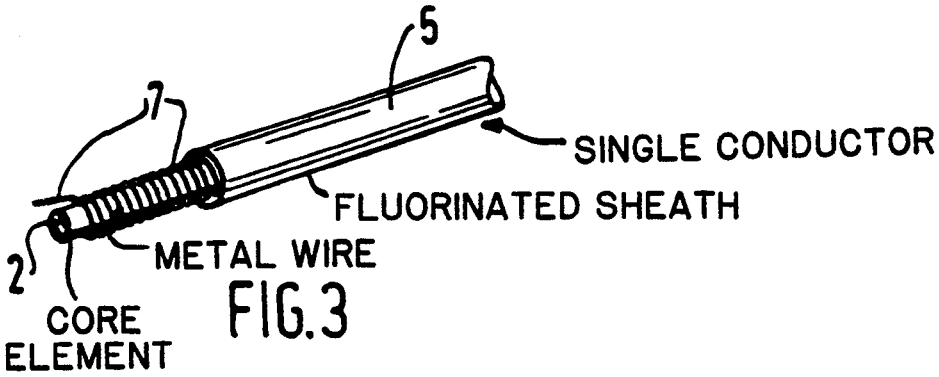
FIG. 3 shows one of the electrical conductors.

As seen in FIG. 3, the basic electrical wires, advantageously of copper or copper alloy, are wound with contiguous turns and a close lay onto a central core 2*b*, generally of high-modulus aramide.

In addition to its insulative role, the fluorinated sheath 5 allows effective slipping of the conductors and intermediate members relative to each other. The braid 3 is a "loose" braid made up of aramide filaments. It must have a long lay (braiding angle less than 15°). It provides the cable's resistance to traction.

It is known that aromatic fibres stretch very little (in the order of 2 to 4%) before they break and they therefore withstand loads applied to the ends of the cable so that the tension is not transmitted to the basic electrical wires.

The polyurethane sheath 4 has no role in the traction resistance but protects the braid against abrasion and more generally against attack by the environment. A film 6 is disposed between the elastic core structure and the braid.

EXAMPLE

A cable in accordance with the invention may comprise:

A 1.5 mm diameter composite central core of Kevlar 49 fibres, specific gravity 1.44, integrated into a polyurethane matrix.

Around this core, six members also with a diameter of 1.5 mm. Two of these members are diametrally opposed electrical conductors made up of twelve copper alloy wires 0.2 mm in diameter wound in contiguous turns about a Kevlar 49 core. Four are intermediate members with the same diameter as the electrical conductors. The electrical conductors are covered with a thin layer of PTFE.

The resulting 1+2+4 assembly constitutes the elastic electrical core structure and has a diameter 4.8 mm.

The core structure is covered by a polyurethane film 6 of 150 microns thickness. Over this combination is a 16 or 17 strand twist of flexible polyamide filament braid with a size of 1,700 dtex (1,500 denier). The braiding angle is open and has a value of 12°. The compacted diameter of the assembly is between 9.6 and 9.7 mm.

A polyurethane sheath 1.15 mm thick is applied over the braid by extrusion or pulstrusion.

The resulting cable has a weight of 140 g/m. Its breaking strength is 7,800 DaN and its self-weight breaking length in air is 56 km.

It goes without saying that numerous variants may be incorporated, notably by substituting technically equivalent means, without departing from the scope of the invention.

We claim:

1. An electrocarrier cable comprising:

a plurality of carrier members which are resistant to traction interleaved with a plurality of electrical conductor members enclosed within an extruded sheath, the conductor members being integrated together with said carrier members to form a relatively extensible elastic central core and being surrounded by relatively inextensible aramide fibers, the conductor members each including at least one metal wire wound with a relatively close lay and with continuous turns around a core element, the core element and a respective said metal wire of the conductor members each being stranded together.

2. The electrocarrier cable according to claim 1, wherein the carrier members from intermediate members of a same diameter as the conductor members, the intermediate members being interleaved with and stranded together with the conductor members.

3. The electrocarrier cable according to claim 1, further comprising a central core of the cable, and wherein the core elements of the conductor members and the central core of the cable comprise stranded high-modulus aramide fibers in a polyurethane matrix.

4. The electrocarrier cable according to claim 1, wherein the aramide fiber strength members define a long lay braid having a braiding angle of no more than 15 degrees.

5. The electrocarrier cable according to claim 1, further comprising a layer of a fluorinated material covering the metal wires.

6. The electrocarrier cable according to claim 1, further comprising a film disposed between the elastic central core and the braid.

* * * * *